US006575065B2

(12) United States Patent
Kapolnek

(10) Patent No.: US 6,575,065 B2
(45) Date of Patent: Jun. 10, 2003

(54) ROTARY BRIDGE ASSEMBLY

(75) Inventor: Paul G. Kapolnek, Chicago, IL (US)

(73) Assignee: Western Printing Machinery Company, Schiller Park, IL (US)

( * ) Notice: Subject to any disclaimer, the term of this patent is extended or adjusted under 35 U.S.C. 154(b) by 123 days.

(21) Appl. No.: 09/739,578

(22) Filed: Dec. 18, 2000

(65) Prior Publication Data

US 2002/0073820 A1 Jun. 20, 2002

(51) Int. Cl.[7] ..... B26D 1/62

(52) U.S. Cl. ..... 83/343; 83/347; 83/436.1; 83/698.42

(58) Field of Search ..... 83/343, 344, 345, 83/346, 347, 348, 659, 698.42, 436.1; 101/249, 480; 16/430; 198/688.1; 492/36, 38

(56) References Cited

U.S. PATENT DOCUMENTS 1,008,604 A * 11/1911 Lake ..... 16/411
2,239,180 A * 4/1941 Kupfer ..... 135/72
2,756,861 A * 7/1956 Emrick ..... 400/662
3,448,479 A * 6/1969 Cademartori ..... 15/230.11
5,910,203 A * 6/1999 Hauser ..... 83/651.1
D440,492 S * 4/2001 Ellers ..... D9/434

OTHER PUBLICATIONS

U.S patent application Ser. No. 09/686,691, Kapolnek, filed Oct. 11, 2000.

* cited by examiner

*Primary Examiner*—Kenneth E. Peterson
(74) *Attorney, Agent, or Firm*—Brinks Hofer Gilson & Lione

(57) ABSTRACT

A bridge assembly includes a urethane-base flexible bridge die having an inner surface and an outer surface. The bridge die is formed for use on a discrete section of a rotary die cylinder and is used with at least one rotary cutting die mounted to the rotary die cylinder. The bridge die has at least one score so that the bridge assembly may be resized by removing a portion of the bridge assembly at the score. A plurality of rubber strips are also included and are attached to the outer surface of the bridge die.

14 Claims, 6 Drawing Sheets

ROTARY BRIDGE ASSEMBLY

FIELD OF THE INVENTION

The invention generally relates to the field of rotary cutting machines, and more particularly, to an improved rotary bridge for use with such rotary cutting machines.

BACKGROUND OF THE INVENTION

Rotary cutting machines are widely used in such industries as the printing or converting industry to cut, score and perforate cutting material such as paper, plastic, cardboard, non-wovens and the like. In general, these rotary cutting machines have two cooperating cylinders, one of which carries a rotary cutting die having a knife or cutting rule, and the other cylinder that acts as an anvil against which the knife bears as the paper is cut. Together, these cylinders help drive cutting material though the machine in order to be processed. The cutting edge of the knife and the surface of the anvil cylinder normally rotate at the same speed and the cutting material is cut as the cutting edge of the knife moves into and out of engagement with the anvil surface.

Rotary cutting dies have been manufactured and used for numerous years. The cutting rule extends above the surface of the rigid die plate and defines a cutting design. The design created by the metallic cutting rule is employed to cut the cutting material during the rotary cutting process.

Conventional rotary cutting dies may be mounted on discrete sections of a rotary cutting machine die cylinder. The die cylinder typically contains a number of receiving holes spaced at predetermined intervals. The receiving holes are positioned in an array along the die cylinder, and are configured to receive screws or other fasteners that extend through a rigid die plate of the rotary cutting die so as to affix the cutting die to the die cylinder. Mounting holes are bored into the die plate to align with the receiving holes in the die cylinder. The rotary cutting die is thus aligned and positioned on the die cylinder to reflect the predetermined pattern for the cutting, scoring or perforating process.

When the die plates are positioned on the die cylinder, there may be sections of the die cylinder that do not have a die plate attached, depending on the particular requirements of the cutting operation. Because the die plates typically have an associated thickness, an unevenness will form between the portions of the cylinder that have die plates attached and those that do not. If this unevenness is left on the cylinder, cutting material being processed may not be effectively driven through the rotary cutting machine. Instead, the cutting material may jam between the cylinders, thereby causing the machine to bind up and preventing the processing of cutting material, and may even lead to the breakage of the rotary cutting die. Stopping operations in order to correct these problems can be time consuming, inconvenient and expensive. Furthermore, this unevenness may cause cutting material to "fly out" from the rotary cutting machine as it is being processed, causing the cutting material to be delivered from the rotary cutting machine and onto a delivery table in an inconsistent and uncontrolled manner, requiring further processing before the cutting material is suitable for use.

One way to eliminate the unevenness is to use multiple layers of rubber or layers of rubber and velcro, stacked on top of each other, to fill in areas where die plates are not attached to the die cylinder. Typically, the layers are adhesively bound to each other, with the innermost layer being adhesively bound to the die cylinder. These stacked layers often need to achieve an overall thickness of the order of ⅝ of an inch, the thickness of a typical die plate. However, rubber has a tendency to degrade when it is layered to a large thickness because the layers are subject to large amounts of tension. The inner surfaces of the stacked layers are compressed, and the outer surfaces are expanded. Therefore, the high rotational speeds the die cylinder typically achieves when in operation, in conjunction with a large expansion of the outer layers of rubber, may cause the rubber to peel or break off from the die cylinder. This can lead to cutting material becoming jammed between the cylinders, causing the problems described above. Furthermore, adhering layers of velcro and/or rubber to the die cylinder may be time consuming.

Another common method used to fill in the areas where die plates are not attached to the die cylinder is to use a bridge manufactured from a rigid, epoxy-base material, mounted to the cylinder die via screws passing through mounting holes on the bridge and the receiving holes of the die cylinder. However, bridges made of an epoxy-base material may be difficult to radially size to fit on a die cylinder. Generally, bridges must be sized to fit on the die cylinder. In particular, each bridge must be manufactured with a mounting radius that precisely matches the radius of the die cylinder on which the bridge is to be mounted. Precise matching of the bridge to the die cylinder is necessary to insure that gaps are not left between the bridge and the die cylinder. As mentioned above, imprecise or inaccurate matching may lead to cutting material becoming jammed between the cylinders, and may lead stress wear that could result in the breakage of the bridge or rotary cutting die.

Manufacturing a bridge made of epoxy-base materials to precisely match the die cylinder can be difficult because epoxy-based materials tend to shrink during the manufacturing process, thereby altering the radius or distorting the shape of the bridge. Moreover, it is nearly impossible to predict the shrinkage of the epoxy-based bridge with any precision. In addition to the problems cited above, shrinkage of the bridge material may create internal stresses that may compromise the integrity of the bridge.

Additionally, if the radius of the bridge does not precisely match the radius of the die cylinder, then the bridge must be "flexed" to fit onto the die cylinder. In other words, the bridge must be "flexed" or bent so as to eliminate any gaps between the bridge and the die cylinder. The rigidity of the epoxy-base material, however, will prevent any appreciable "flexing" of the bridge. If the bridge cannot be "flexed" sufficiently to fit onto the die cylinder, then the bridge is typically discarded.

In the event that the bridge is "flexed" to fit onto the die cylinder, additional mounting fasteners or clamps will usually be required to secure and hold the bridge against the die cylinder. These additional mounting fasteners will necessarily require the installation of additional receiving holes in the die cylinder.

"Flexing" of the bridge to fit the die cylinder may also cause adverse stresses in the bridge. Because epoxy-base materials are typically brittle, these adverse stresses may lead to the fracturing or shattering of the bridge. Moreover, a dangerous situation may be created if the bridge shatters. Shattered pieces of the bridge may be propelled outwardly from the die cylinder.

Furthermore, stacked layers and epoxy-based bridges are difficult to reconfigure for different processing operations. Generally, for a first type of cutting operation, a predetermined number of rotary cutting dies will be mounted to the die cylinder in a predetermined configuration. Stacked layers or epoxy-base bridges will be attached to the die cylinder in the areas where the rotary cutting die is not so attached. When the first operation is finished, a second type of operation may be begun. However, when a different operation is begun, the configuration of the rotary cutting dies on the die cylinder, the number of rotary cutting dies required, or both, may change. If this occurs, the shape and size of the areas on the die cylinder for mounting stacked layers or bridges will change. Because stacked layers are adhesively bound to the die cylinder, reshaping them to accommodate the second operation may be time consuming, messy, and may tear the layers. Epoxy-base materials, on the other hand, will generally be too brittle to reshape.

Accordingly, it would be desirable to have a bridge that overcomes the disadvantages and limitations described above.

SUMMARY OF THE INVENTION

In view of the above, the present invention provides a unique rotary bridge assembly that overcomes the disadvantages and limitations described above. According to a first aspect of the present invention, the bridge assembly includes a urethane-base flexible bridge die having an inner surface and an outer surface. The bridge die is formed for use on a discrete section of a rotary die cylinder and is used with at least one rotary cutting die mounted to the rotary die cylinder. The bridge die has at least one score so that the bridge assembly may be resized by removing a portion of the bridge assembly at the score. A plurality of rubber strips are also included and are attached to the outer surface of the bridge die.

Another aspect of the bridge assembly provides a urethane-base flexible bridge die being formed of a polyurea elastomer material having a hardness of 60±5 (Shore D) and being sized for use on a discrete section of a rotary die cylinder.

Another aspect of the bridge assembly provides a urethane-base flexible bridge die being of a polyurea elastomer having a hardness of 60±5 (Shore D). The bridge die has an inner surface, an outer surface, a plurality of scores, and a plurality of mounting holes. The plurality of scores allows the bridge assembly to be resized by removing a portion of the bridge assembly at a score. The plurality of mounting holes passes through the inner surface and the outer surface and are for mounting the bridge assembly to a rotary die cylinder. The bridge die is yellow in color and is sized for use on a discrete section of the rotary die cylinder. A plurality of rubber strips are attached to the outer surface of the bridge die and are at least 1/16 inches thick. The bridge die and the rubber strips together form a thickness that is at least 3/16 inches.

Another aspect of the invention includes a rotary cutting machine. The rotary cutting machine includes a rotary die cylinder, an anvil cylinder, at least one rotary cutting die, and at least one bridge assembly. The rotary cutting die includes a cutting rule and is formed for use on and mounted to a discrete section of the rotary die cylinder. The bridge assembly is formed for use on the remaining sections of the rotary die cylinder and mounted to the rotary die cylinder. Together, the rotary die cylinder and the anvil cylinder drive a cutting material between them for processing by the cutting rule.

The preferred embodiment of the invention includes features in addition to those listed above. Moreover, the advantages over the current art discussed above are directly applicable to the preferred embodiment, but are not exclusive. The other features and advantages of the present invention will be further understood and appreciated when considered in relation to the detailed description of the preferred embodiment.

DETAILED DESCRIPTION OF THE PRESENTLY PREFERRED EMBODIMENTS

Figure 1:
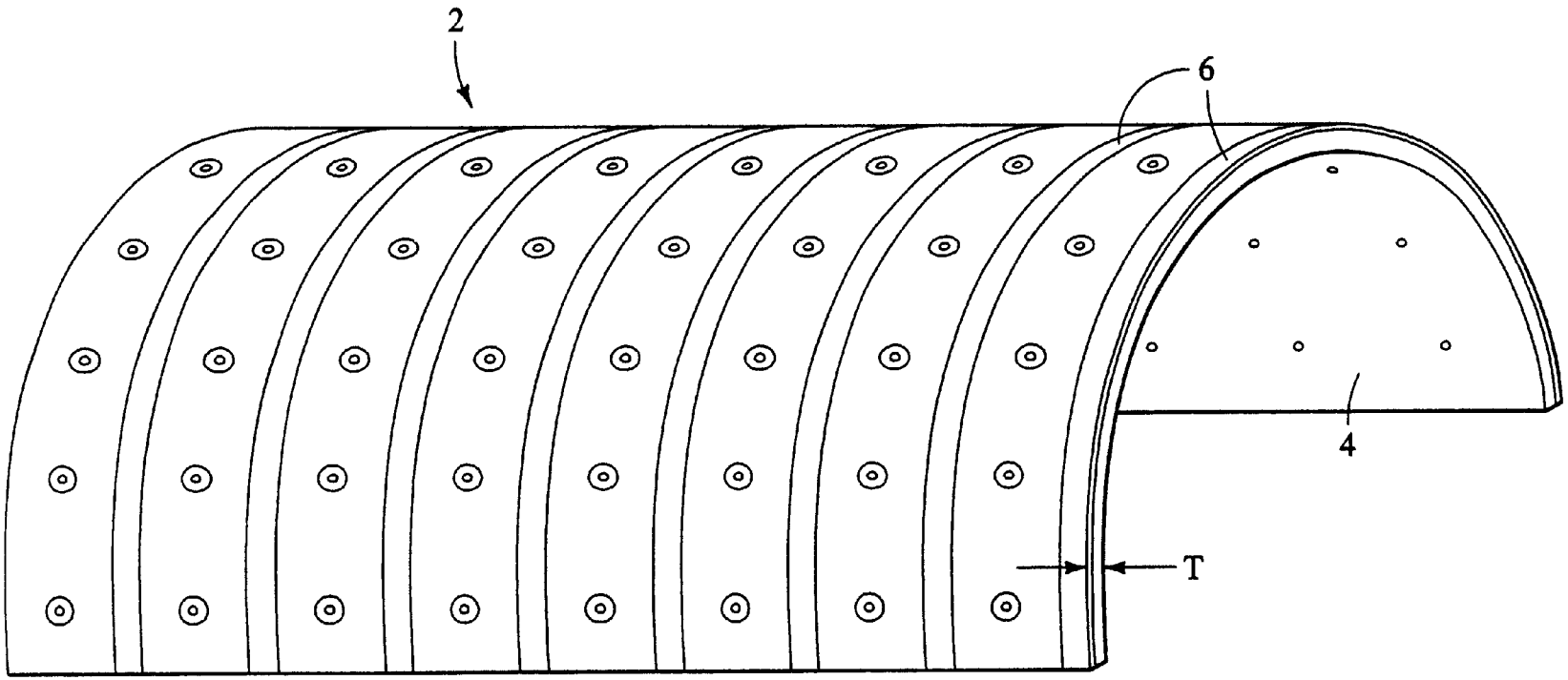
FIG. 1 is a perspective view of a rotary bridge assembly.
Figure 2:
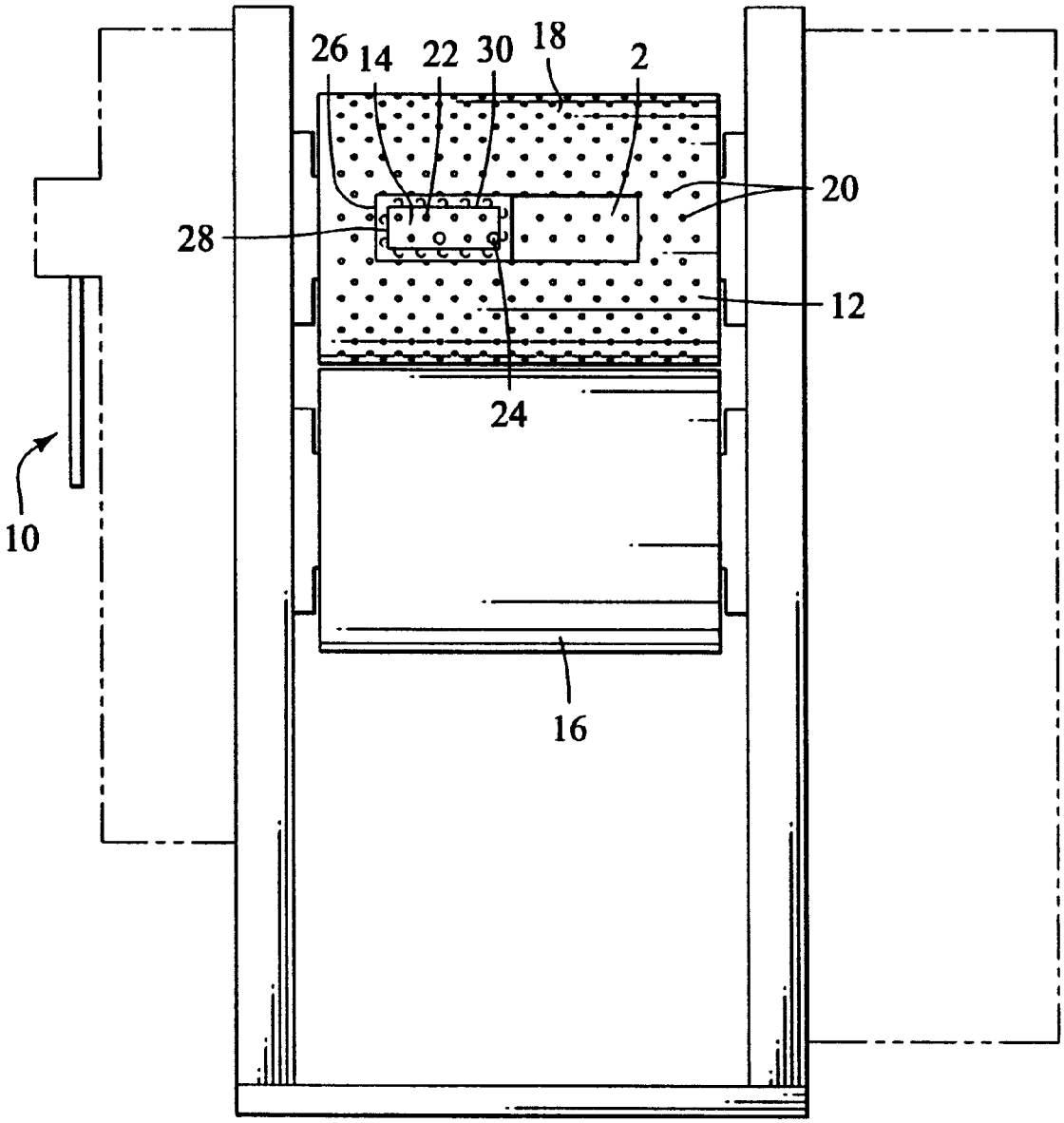
FIG. 2 is a perspective view of a rotary cutting machine showing a rotary cutting die and a bridge assembly disposed along a cutting cylinder.

Referring now to the drawings, FIGS. 1 and 2 show the preferred embodiment of a rotary bridge assembly 2. When in use, the rotary bridge assembly 2 is attached to a rotary cutting machine 10, shown in FIG. 2. The rotary cutting machine 10 is used to cut, score, or perforate cutting material such as paper, cardboard, plastic, polyethylene, non-wovens, or paperboard into a predetermined pattern. Before further details are provided about the rotary bridge assembly 2, further detail about the rotary cutting machine 10 is set forth herein.

The rotary cutting machine 10 includes a die cylinder 12, at least one rotary cutting die 14 mounted to the die cylinder 12, and an opposing cylinder 16. The preferred die cylinder 12 contains a plurality of mounting holes 20 positioned in a uniform matrix or array about its outer surface 18. The rotary cutting die 14 is mounted on the die cylinder 12 by means of a plurality of fasteners 24 disposed through plate holes 22 located on a rotary die plate 26. The fasteners 24 are secured within the mounting holes 20 in the die cylinder 12 to mount the rotary cutting die 14 to the die cylinder 12. Any suitable form of fastener may be utilized to secure the rotary die plate 26 on the die cylinder 12. In one preferred embodiment of the invention, the fasteners 24 comprise screws, or the like, that turn into the preferably threaded mounting holes 20 in the die cylinder 12. The number of rotary cutting dies mounted to the die cylinder can vary, and will depend on the type of process to be performed. Additionally, where the rotary cutting dies will be place on the die cylinder will also depend on the process to be performed.

The rotary cutting die 14 includes a cutting rule 28 supported in the rotary die plate 26. The cutting rule 28 has a cutting edge 30, which extends outwardly from the rotary die plate 26. The cutting rule 28 forms a predetermined cutting design on the rotary cutting die 14.

The cutting edge 30 of the cutting rule 28 is preferably sharp to enable it to cut, score or perforate the design into a given cutting material (not shown). Preferably, the cutting edge 30 extends approximately 1/8 inch outwardly from the rotary die plate 26. However, as those skilled in the art will appreciate, the cutting edge 30 may extend to any distance dictated by a specific application without departing from the spirit and scope of the invention.

The rotary cutting machine 10 also includes an opposing cylinder 16 positioned parallel to and in opposite rotary relationship with the die cylinder 12. During operation of the rotary cutting machine 10, cutting material is fed between the die cylinder 12 and the opposing cylinder 16. When the rotary cutting machine 10 is in operation, the opposing cylinder 16 rotates counter to the die cylinder 12 and provides a surface against which the cutting edge 30 bears during the cutting process. The cutting rule 28 in the rotary die plate 26, which is mounted on the die cylinder 12, and the opposing cylinder 16 cooperate to cut, score or perforate the cutting material in the pattern of the cutting design. The cutting rule 28 and the opposing cylinder 16 normally rotate at the same speed and the cutting material is cut as the cutting edge 30 moves into and out of engagement with opposing cylinder 16.

Referring back to FIGS. 1 and 3, the rotary bridge assembly 2 includes a bridge die 4 and a plurality of rubber strips 6 disposed over an outer surface 8 (see FIG. 3) of the bridge die 4. Preferably, the rubber strips 6 are each a thin layer of a suitable elastomeric rubber, and preferably have a thickness of approximately one-sixteenth to one-fourth of an inch. In other embodiments, however, thin strips of velcro disposed over strips of rubber may be used. Alternatively, a thick foam rubber may be used. The strips 6 are adhesively attached to the outer surface 8 of the bridge die 4 and preferably are oriented between rows of receiving holes 36 in the bridge die. Note that in other embodiments, a thin layer of rubber may be disposed over the entire outer surface, having a plurality of openings pass through the rubber layer that are positioned to align over the receiving holes in the bridge die. The strips 6 assists with the feeding of cutting material between the die cylinder 12 and the opposing cylinder 16 by providing a gripping-type surface for the cutting material.

Figure 3:
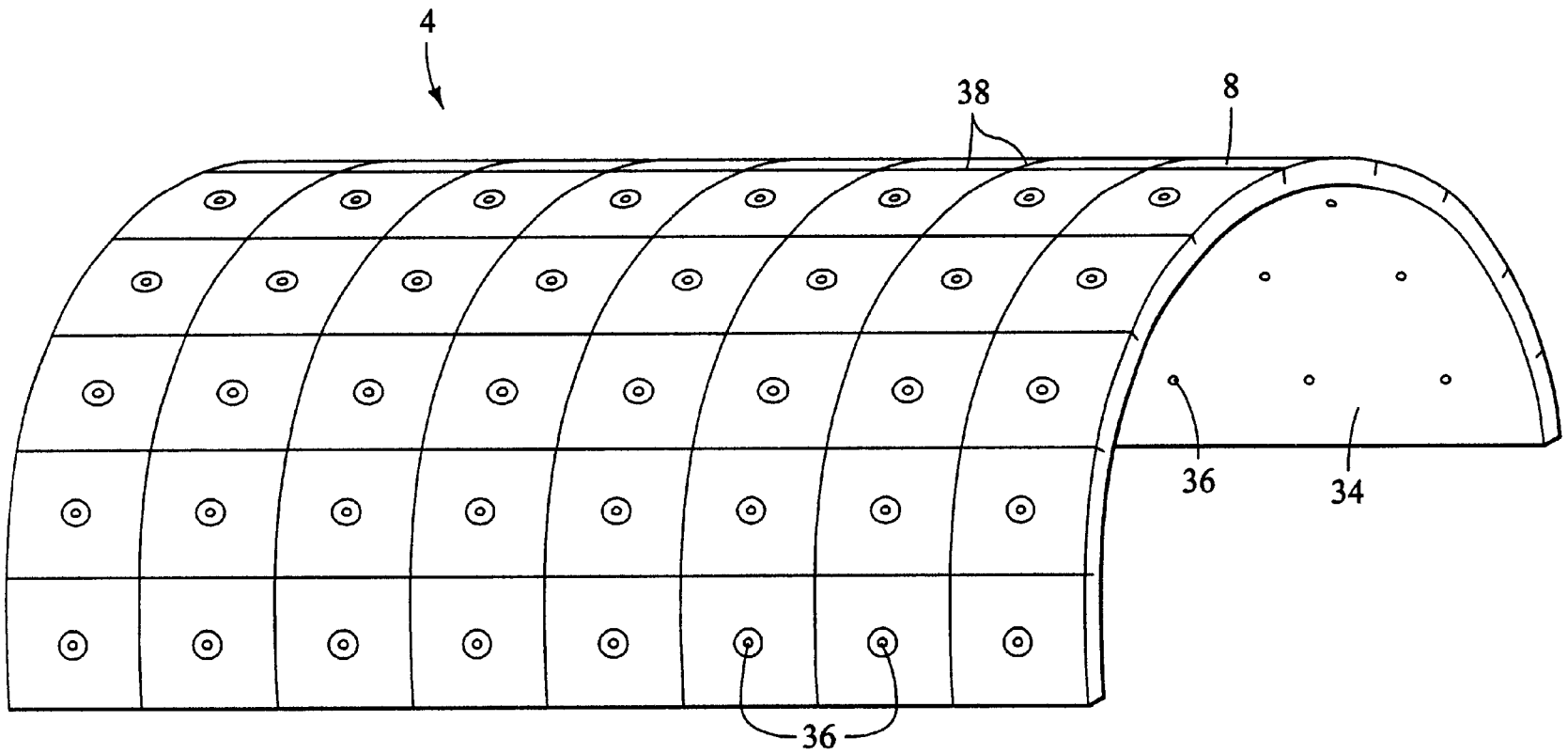
FIG. 3 is a perspective view of a bridge die.

As shown in FIG. 3, the bridge die 4 includes an outer surface 8, an inner surface 34, a plurality of receiving holes 36, and a plurality of scores 38. The receiving holes 36 are bored through the inner and outer surfaces 8, 34, and allow the bridge die 4 to be mounted to the die cylinder 12. The bridge die 4 preferably will be mounted to areas of the die cylinder 12 where the rotary cutting die 14 is not attached. Note however, that other embodiments contemplate mounting the bridge die to the die cylinder without the use of receiving holes. For example, a bridge die could be magnetically attached to a die cylinder made from a ferrous material, thereby eliminating the need for receiving holes.

Preferably, the receiving holes 36 are positioned in a uniform matrix or array about the outer surface 8 so that when the bridge die 4 is mounted to the die cylinder 12 the receiving holes 36 are aligned over the mounting holes 20. Similar to the rotary cutting die 14, the bridge die 4 is mounted on the die cylinder 12 by means of a plurality of fasteners 24. The fasteners 24 are secured within the mounting holes 20 in the die cylinder 12 to mount the rotary cutting die 14 to the die cylinder 12.

Preferably, the bridge die 4 is formed so that that the bridge die 4 and the strips 6 together have a thickness T approximately equal to that of the rotary die plate 26. Generally, rotary die plates 26 are formed to have a predetermined thickness, preferably between 3/16 to 5/8 inches, although other thicknesses as dictated by particular uses for the rotary cutting die are also contemplated. Typically, when the rotary cutting dies 14 are mounted to the die cylinder 12, an unevenness will be created between the areas of the die cylinder 12 that have rotary die plates 26 mounted to them and those that do not. If this unevenness is left unattended, cutting material being processed may jam between the die cylinder and the opposing cylinder, causing the machine to bind up and to be unable to process cutting material, and may even lead to breakage of the rotary cutting die. Forming the bridge assembly 2 to have substantially the same thickness T as the rotary die plate 26 will eliminate the unevenness.

Figure 4:
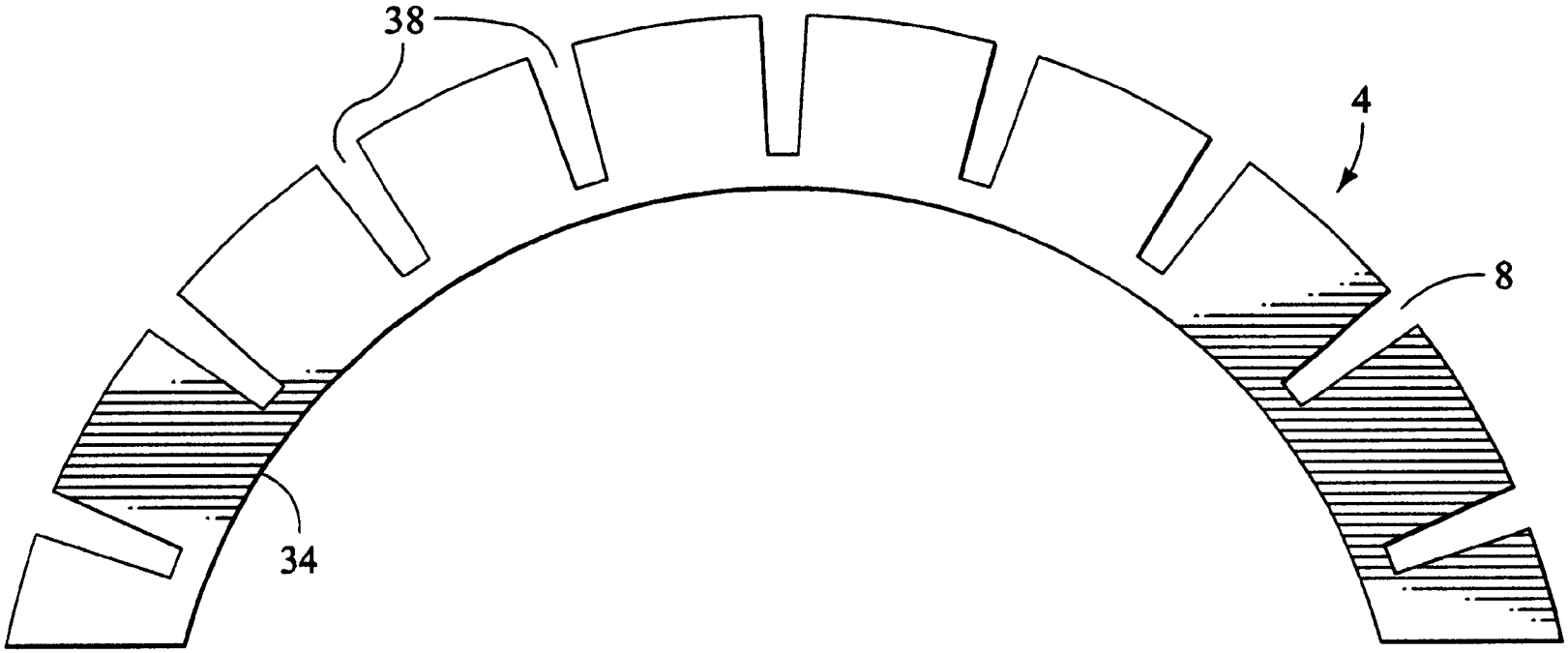
FIG. 4 is a front plan exaggerated view of the bridge die of FIG. 3 showing scores.

Referring to FIG. 4, which depicts an exaggerated view of the scores 38, the scores 38 are open spaces in the bridge die 4 that extend from the outer surface 8 of the bridge die 4 and extend towards the inner surface 34. However, so that the bridge die 4 does not separate into pieces, the scores 38 do not extend all the way to the inner surface 34. Instead, the scores 38 preferably will extend approximately 90% of the distance from the outer surface 8 towards the inner surface 34. In other embodiments, however, this amount may be varied depending on the materials used and operating requirements. The scores 38 preferably are approximately four inches apart from each other, and extend lengthwise and crosswise over the outer surface 8 to form a substantially uniform matrix. Again, however, in other embodiments the distance between scores may be varied, and they do not have to be uniformly positioned.

The scores allow the size of the bridge die to be altered. Generally, for one given operation, a predetermined number of rotary cutting dies will be mounted to the die cylinder in a predetermined configuration. As discussed above, the bridge assembly will be attached to the die cylinder in the areas where the rotary cutting die is not so attached. When the first operation is finished, another cutting operation may be contemplated. A different operation, however, may require a different configuration of the rotary cutting die on the die cylinder, a different number of rotary cutting dies, or both. If these changes are required, the shape and size of the areas on the die cylinder for mounting the bridge assembly (ies) will change. By providing scores, the bridge assemblies may be easily reshaped or reconfigured for mounting onto the die cylinder. In one preferred method, a razor may be used to cut the bridge assembly at the scores, thereby reshaping the bridge assembly.

Additionally, in other embodiments the rubber strips may include a plurality of scores configured substantially the same way as the scores on the bridge die and that align with the scores of the bridge die. The scores extend from a top surface of the rubber layer towards an inner surface of the rubber layer, preferably extending approximately 90% of the distance from the top surface to the inner surface.

The bridge die 4 may be formed of any suitable material to obtain a desired flexibility and durability. Preferably, the bridge die 4 is formed of a urethane-based material that exhibits a low shrink factor upon hardening during the manufacturing process. A low shrink factor is desired to ensure that the required shape of the bridge die 4 is retained. A preferred urethane-based material is distributed by Ciba Geigy Corp., located in East Lansing, Mich. This particular material is a wear resistant, semi-rigid, black, two-component polyurea elastomer having a hardness of approximately 60±5 (Shore D). An alternative urethane-based material that can be used for the bridge die has properties similar to the preferred material, but is red in color. Both of these materials are referred to as Polyurea Elastomer, of which there are several types. Of course, any material, and particularly urethane-based materials, having the required properties can be used for the bridge die 4.

The urethane-base material of the preferred embodiment can also be altered with additives, dyes or color pastes to change the color of the bridge die 4. Preferably, if the urethane-base material is altered, the rubber strips will be the same color as the urethane-base material, but may be a different color as well. Changing the color of the material may be advantageous for a number of reasons, such as increasing the visibility of the rotary cutting die 14. Moreover, altering the bridge die 4 to be substantially the same color as the rotary die plate 26 will provide a uniformly colored surface disposed over the die cylinder 12, enhancing the visibility of the rotary cutting die 14 and cutting rule 28. Since the die cylinder 12 is typically rotated at a high rate of speed, increasing the visibility of these components may enhance the safety to the operator. For example, manufacturing the rotary die plate 14 from a urethane-base material that has been dyed a light color such as white, yellow or red would improve an operator's ability to see the contrasting dark colored cutting rule 12, even when the die cylinder 26 is rotating. Different colorings may also improve an operator's ability to inspect for wear or damage.

The urethane-based material of the preferred embodiment, when cured, is more flexible than rigid epoxy-based materials that are typically used for conventional rotary cutting dies. The flexibility of the urethane-based material allows the bridge die 4 to be flexed or deformed as necessary to fit onto the surface of the die cylinder 12. This eliminates the need to manufacture the bridge die 4 with a radius precisely matching the radius of the die cylinder 12, thereby reducing manufacturing costs. Moreover, a bridge die 4 can be flexed to fit onto die cylinders 12 of different radii. This eliminates the need to manufacture individual bridge die 4 for individual die cylinders 12.

Furthermore, the bridge assembly will assist in delivering the products in a consistent and controlled way. If a bridge assembly is not used, cutting material is more likely to "catch air" as it is bent around the rotary cutting die and "fly out" from the rotary cutting machine. In contrast, the bridge assembly causes slight ripples in the cutting material that stiffens the product to allow it to move smoothly and consistently from the rotary cutting machine and to a delivery table.

The bridge assembly 2 of the present invention is also a more durable and safer product. In particular, the flexibility of a bridge die 4 reduces any adverse stresses that may be incurred, making the bridge die unlikely to shatter and thereby reducing or eliminating potentially dangerous situations.

The use of the flexible bridge die also allows strips of a minimal thickness to be attached to the outer surface. This prevents the rubber from tearing or degrading during operation of the rotary cutting machine, as will often happen when a bridge assembly made up of thick layers of rubber or rubber and velcro are used. In turn, this will prevent the die cylinder and the opposing cylinder from jamming, and will reduce or eliminate potentially dangerous situations.

Additionally, the use of the flexible bridge die and strips allows for faster preparation for operations. Often, layers of rubber or rubber and velcro are adhesively stacked upon each other in layers directly onto the die cylinder. This can be time-consuming, as operations may not be started until all the layers are applied to the die cylinder. In contrast, the bridge assembly of the preferred embodiments allows strips to be applied to bridge dies in preparation for future operations while operations are currently being carried out. Layers do not need to be adhesively stacked directly onto the die cylinder, which may delay the start of operations.

Figure 5:
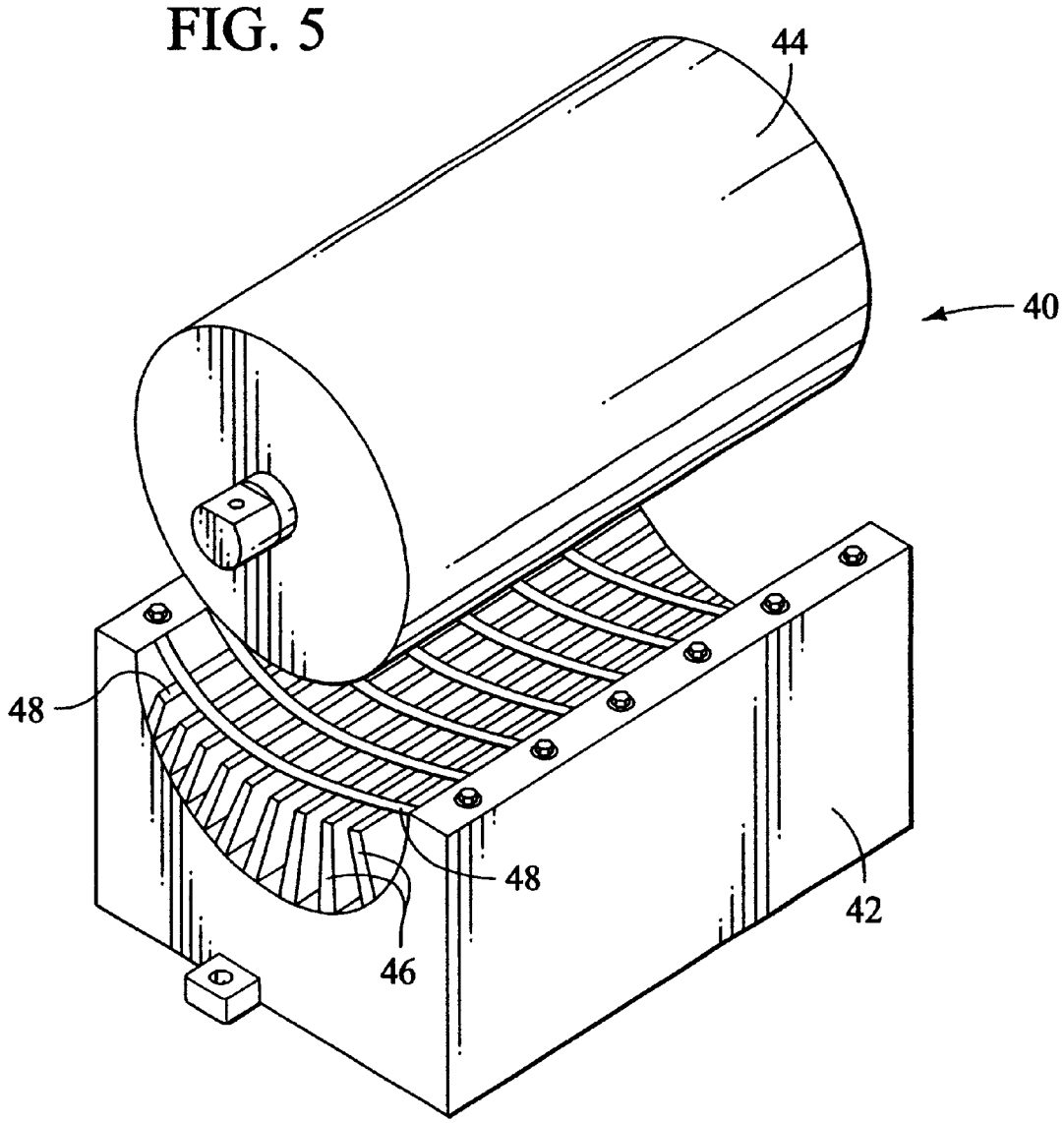
FIG. 5 is a partially exploded perspective view of a bridge die mold.
Figure 6:
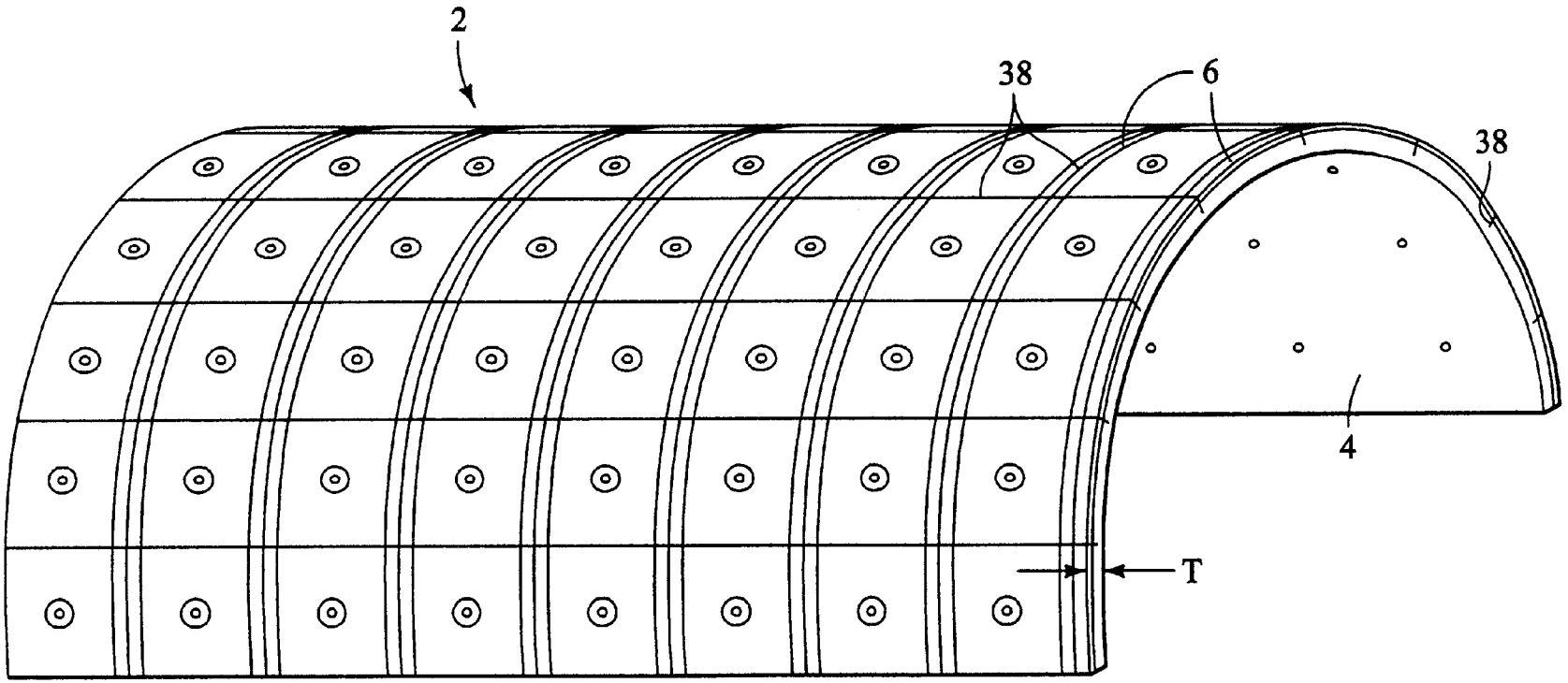
FIG. 6 is a view showing scores on the rubber strips.

A method for forming the bridge assembly 2 is described below. As shown in FIG. 5, a die mold 40 for molding the bridge die 4 is provided having a receiver mold 42 and a mold cylinder 44. An inner side 48 of the receiver mold 42 is formed having a circularly shaped curve whose radius is substantially the same size radius as a die cylinder 12 to be used to process cutting material. The mold cylinder 44 is also formed to have substantially the same radius as die cylinder 12. A plurality of dividers 46 (shown in exaggeration in FIG. 5) extend upwardly from the inner side 48 of the receiver mold 42. The dividers 46 are configured to form the scores 38 on the bridge die 4.

The mold cylinder 44 is lowered towards the inner side 48 of the receiver mold 42 so that a space is left between the mold cylinder 44 and the receiver mold 42 that corresponds to the contemplated thickness for the bridge die 4. The mold 40 is then sealed. A urethane-based die plate material (preferably having a low shrink factor) is injected into the mold 40 at ambient temperature. The urethane-based material is cured at an elevated temperature until the urethane hardens and forms the durable, flexible bridge die 4 on the inner side 48 of the receiver mold 42. Preferably, the die plate material is cured at 180° F., although it is contemplated that various other curing temperatures may be used depending on the particular urethane-based material and the specific application.

Subsequent to the bridge die 4 being formed, the mold cylinder 44 is raised, and the bridge die 4 is removed. Thin strips of rubber as described above are then adhesively attached to the outer surface of the bridge die, forming the bridge assembly. The bridge assembly may now be mounted to the die cylinder via the ways described above.

It should be appreciated that the present invention may be performed or configured as appropriate for the application. The embodiments described above are to be considered in all respects only as illustrative and not restrictive. The scope of the invention is indicated by the claims rather than by the foregoing description. All changes, which come within the meaning and range of equivalency of the claims, are to be embraced within their scope.

I claim:

1. A bridge assembly comprising:

a urethane-base flexible bridge die having an axis of curvature, a concave inner surface, an outer surface concentric with said inner surface, a first peripheral end and a second peripheral end, the bridge die being formed for use on a discrete section of a rotary die cylinder and for use with at least one rotary cutting die mounted to the rotary die cylinder, said rotary cutting die having a cutting rule, said bridge die having at least one score for resizing the bridge assembly by removing a portion of the bridge assembly at the score, said score extending generally parallel to said axis of curvature; and a plurality of rubber strips attached to the outer surface of the bridge die, said rubber strips starting generally at said first peripheral end and ending generally at said second peripheral end.

2. The bridge assembly of claim 1, wherein the urethane-based flexible bridge die comprises a polyurea elastomer material having a hardness of 60±5 (Shore D).

3. The bridge assembly of claim 1 further comprising a thickness of at least 3/16 inches thick.

4. The bridge assembly of claim 1, wherein the score further comprises an open area extending from the outer surface of the bridge die towards the inner surface of the bridge die, the score not extending more than 90% of the distance from the outer surface to the inner surface.

5. The bridge assembly of claim 1, wherein the rubber strips further comprise scores.

6. The bridge assembly of claim 5, wherein a score further comprises an open area extending from the outer surface of the rubber strip towards the inner surface of the rubber strip, the score not extending more than 90% of the distance from the outer surface to the inner surface.

7. The bridge assembly of claim 1, wherein the rubber strips are formed to a thickness of at least 1/16 inches thick.

8. The bridge assembly of claim 1 further comprising at least one score extending generally perpendicular to said axis of curvature for resizing the bridge assembly by removing a portion of the bridge assembly at the score.

9. A bridge assembly comprising:

a urethane-base flexible bridge die comprising an axis of curvature, a concave inner surface, an outer surface concentric with said inner surface, a first peripheral end and a second peripheral end, the bridge die being formed of a polyurea elastomer material having a hardness of 60±5 (Shore D) and being sized for use on a discrete section of a rotary die cylinder, the bridge die having at least one score for resizing the bridge assembly by removing a portion of the bridge assembly at the score, said score extending generally parallel to said axis of curvature; and a plurality of rubber strips attached to the outer surface of the bridge die, the rubber strips being formed to have a thickness of at least 1/16 inch, said rubber strips starting generally at said first peripheral end and ending generally at said second peripheral end.

10. The bridge assembly of claim 9 further comprising a thickness in the range of at least 3/16 inches thick.

11. The bridge assembly of claim 9, wherein the score further comprises an open area extending from the outer surface of the bridge die towards the inner surface of the bridge die, the score not extending more than 90% of the distance from the outer surface to the inner surface.

12. The bridge assembly of claim 9, wherein the rubber strips further comprise scores.

13. The bridge assembly of claim 12, wherein a score further comprises an open area extending from the outer surface of the rubber strip towards the inner surface of the rubber strip, the score not extending more than 90% of the distance from the outer surface to the inner surface.

14. The bridge assembly of claim 9 further comprising at least one score extending generally perpendicular to said axis of curvature for resizing the bridge assembly by removing a portion of the bridge assembly at the score.

* * * * *